US007111528B1

(12) United States Patent
Foster

(10) Patent No.: US 7,111,528 B1
(45) Date of Patent: Sep. 26, 2006

(54) MULTIPURPOSE GRASPING PART HOLDER

(76) Inventor: Marlene M. Foster, 547 Rustic Rd., West Jefferson, NC (US) 28694

( * ) Notice: Subject to any disclaimer, the term of this patent is extended or adjusted under 35 U.S.C. 154(b) by 128 days.

(21) Appl. No.: 11/004,510

(22) Filed: Dec. 6, 2004

Related U.S. Application Data

(60) Provisional application No. 60/527,597, filed on Dec. 8, 2003.

(51) Int. Cl.
*B25B 13/52* (2006.01)
*B25B 17/00* (2006.01)

(52) U.S. Cl. ..... 81/64; 81/57; 81/177.6

(58) Field of Classification Search ..... 81/64, 81/57, 177.6, 177.75, 177.7, 13; 403/116, 403/157

See application file for complete search history.

(56) References Cited

U.S. PATENT DOCUMENTS 2,372,930 A * 4/1945 Bovee ..... 81/64
3,203,285 A * 8/1965 Schmidt ..... 81/177.6
3,728,916 A * 4/1973 Brantley ..... 81/64
4,324,158 A * 4/1982 Le Roy ..... 81/60
4,436,003 A * 3/1984 Cox ..... 81/57.43
4,543,858 A * 10/1985 Luck ..... 81/64
4,876,929 A 10/1989 Kozak
5,509,705 A * 4/1996 Woodsum ..... 294/1.1
5,697,269 A 12/1997 Tseng
5,797,670 A * 8/1998 Snoke et al. ..... 362/119
5,896,792 A 4/1999 Hurt
5,904,077 A 5/1999 Wright et al.
5,921,561 A 7/1999 Cedarberg, III
D427,041 S 6/2000 Cedarberg, III
6,142,486 A * 11/2000 Cedarberg, III ..... 279/103
6,302,000 B1 10/2001 Smith
6,421,896 B1 * 7/2002 Beyer ..... 29/213.1

* cited by examiner

*Primary Examiner*—Lee D. Wilson
*Assistant Examiner*—Alvin J Grant
(74) *Attorney, Agent, or Firm*—John D. Gugliotta

(57) ABSTRACT

A hand tool is provided with a flexible arm containing a flexible gripping strap. The strap forms an adjustable closed loop positioned at one end, and extends through the arm at the other end. The loop is used for securing to a nut, bolt, or similar part that is positioned in a difficult to reach place. The flexible arm may be bent and formed to hold a specific shape, thus allowing it to fit into areas where most common hand tools cannot. Tension on the loop is increased by pulling the rubber strap. A lock secures the strap to retain the tension.

9 Claims, 2 Drawing Sheets

MULTIPURPOSE GRASPING PART HOLDER

RELATED APPLICATIONS

The present invention claims the benefit of U.S. Provisional Patent No. 60/527,597 filed on Dec. 8, 2003.

BACKGROUND OF THE INVENTION

1. Field of the Invention

The present invention relates generally to hand tools and, more particularly, to a multipurpose grasping part holder.

2. Description of the Related Art

A basic problem that occurs during installation and removal of small hardware parts (e.g., screws, washers, nuts, bolts, spacers, etc) is the accidental, or unintentional, dropping of the small hardware parts, which may become lost. The problem of dropping small parts appears to occur more frequently when small parts are installed by hand. If small parts are dropped within or in close proximity to elements of flight hardware, the small parts may not be recoverable, thereby increasing the probability of damage to the flight hardware during processing or flight.

Anyone who has ever used a wrench can understand the frustration of trying to loosen and remove a bolt or nut that is in a difficult to reach location, particularly if it is an enclosed and out of sight location. These are locations such as behind on a starter, alternator, stereos, heater core, heater ducts, power supplies, refrigerator units and shocks.

Sometimes even using a long lever arm to turn the wrench is not enough. Very often the bolt or nut is located in a location where attempting to start or loosen it makes the task more difficult, even with other types of gripping tools.

Other conventional techniques for holding objects to an existing fastening member, such as a screw joint, exists. Temporary attachment via adhesive or tape is known, as is to clamp the holder between a screw head or, alternatively, between a nut and a fastening surface. Such a holder can be constructed as an angularly bent sheet-metal bracket which is provided with a hole, through which the screw extends. The screw member may, for example, form part of a vehicle beam construction for the purpose of keeping structural members together. In this regard, the holder must be mounted at the same time as the preparation of the screw joint, wherein there is a risk of the holder changing position to an incorrect position during tightening, due to the friction between the holder and parts in the screw joint. Furthermore, the holder is exposed to the same tightening forces as the screw joint itself, which demands a great deal of the physical properties of the holder material.

In all these cases there is a need to gasp a required part in an adjustable fashion, followed by being able to bend, twist or capable of flexing into a specific shape, thus allowing it to fit into areas where most common hand tools cannot.

The object of the present invention is to eliminate the above-mentioned problems and to provide a holder which is easy to mount and later exchange and which can be adjusted and kept in a fixed position.

A search of the prior art did not disclose any patents that read directly on the claims of the instant invention; however, the following references were considered related.

Consequently, a need has been felt for providing an apparatus and method of gasping a required part in an adjustable fashion and being able to bend, twist or capable of flexing into a specific shape, thus allowing it to fit into areas where most common hand tools cannot.

SUMMARY OF THE INVENTION

It is therefore an object of the present invention to provide an improved multipurpose grasping part holder.

It is a feature of the present invention to provide an improved multipurpose grasping part holder having a flexible arm that can be bent into various positions to enable the tool to fit numerous difficult to reach places.

Briefly described according to one embodiment of the present invention, a hand tool is provided with a flexible arm containing a flexible gripping strap. The strap forms an adjustable closed loop positioned at one end, and extends through the arm at the other end. The loop is used for securing to a nut, bolt, or similar part that is positioned in a difficult to reach place. The flexible arm may be bent and formed to hold a specific shape, thus allowing it to fit into areas where most common hand tools cannot. Tension on the loop is increased by pulling the rubber strap. A locking means secures the strap to retain the tension.

An advantage of the present invention is that it is a general purpose tool, allowing for the holding and securing many types of miscellaneous parts.

Another advantage of the present invention is that it is capable of flexing and bending into a specific shape, thus allowing it to fit into areas where most common hand tools cannot.

Further, additional features, such as an illumination means, can be attached to the distal end of the tool to provide additional functionality.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
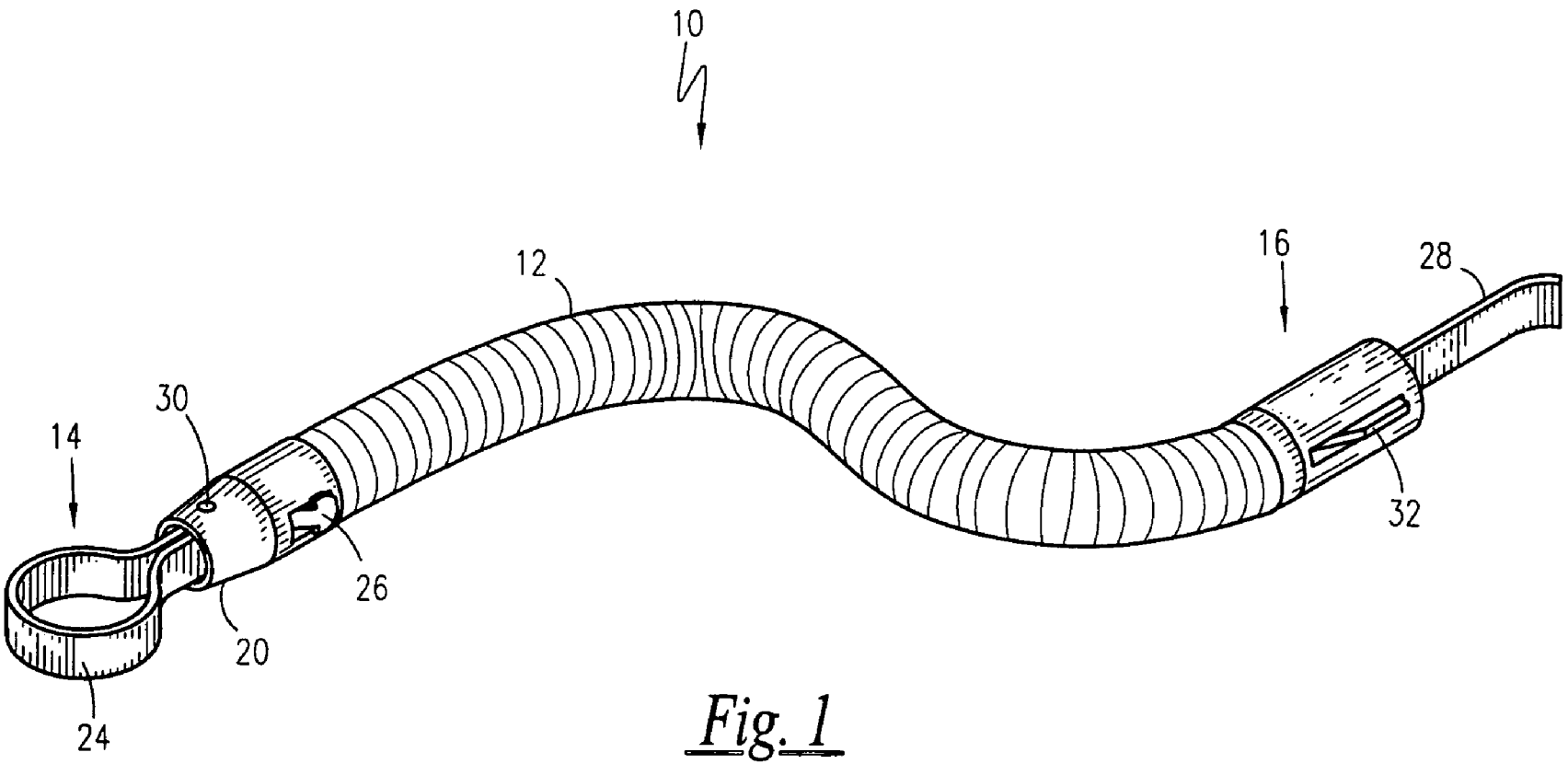
FIG. 1 is a perspective view of a multipurpose grasping part holder according to the preferred embodiment of the present invention.
Figure 2:
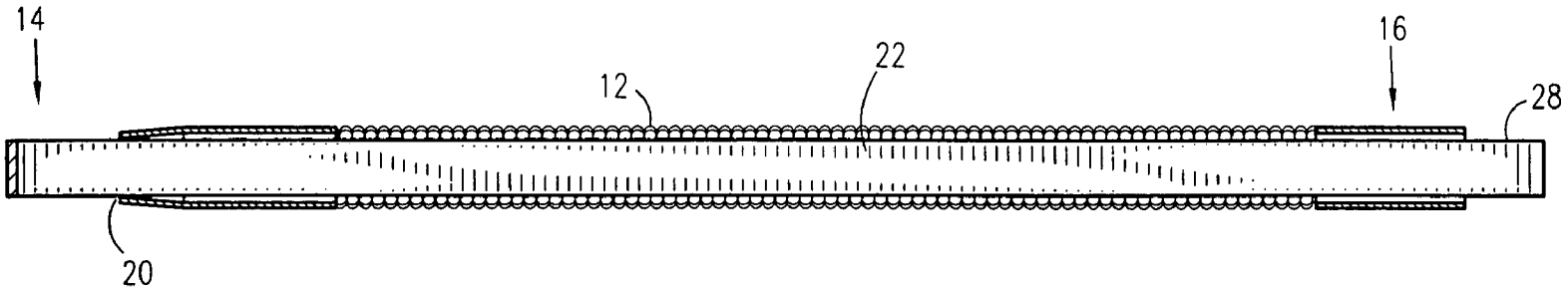
FIG. 2 is cross sectional view thereof taken along the linear centerline of the shaft 12.

Referring now to FIGS. 1 and 2, a multipurpose grasping part holder apparatus 10 is shown, according to the present invention, comprising generally a cylindrical flexible shaft 12 forming a distal end 14 opposite a proximal end 16. A flexible gripping strap 22 forms a prehensile loop 24 at the distal end 14. This loop 24 is formed by having one end of the strap 22 terminated to an attachment point 26 at the inside of the flexible shaft 12, with the other end extending through the shaft 12 entirely to extend into an adjustment tab 28. It is anticipated that the shaft 12 and strap 22 are electrically insulated or otherwise nonconductive to allow for use with or around electrical wiring, appliances, or connections. The distal end 14 terminates at a collet 20 with an impingement 30, shown as a shaft bisecting the distal orifice of the collet 20, prevents the gripping strap 22 from being pulled completely through the shaft 12. A locking means 32, shown as a sliding wedge to impinge the tab 28 against the inside sidewall of the shaft 12, secures the strap to retain the tension on the loop 24.

2. Operation of the Preferred Embodiment

To use the present invention, a user would angle and adjust the flexible shaft 12 into the area required. The adjustable, prehensile loop 24 is then placed around the part being secured, and the opposite end at the tab 28 is pulled, thereby tightening the grip on the part being secured. Unlike conventional tools, the current device can be bent and formed into any position to place a grip on a given part. The locking means 32 can be secured to maintain the grip on the part, or released in order to lessen the gripping force on the part.

Figure 3:
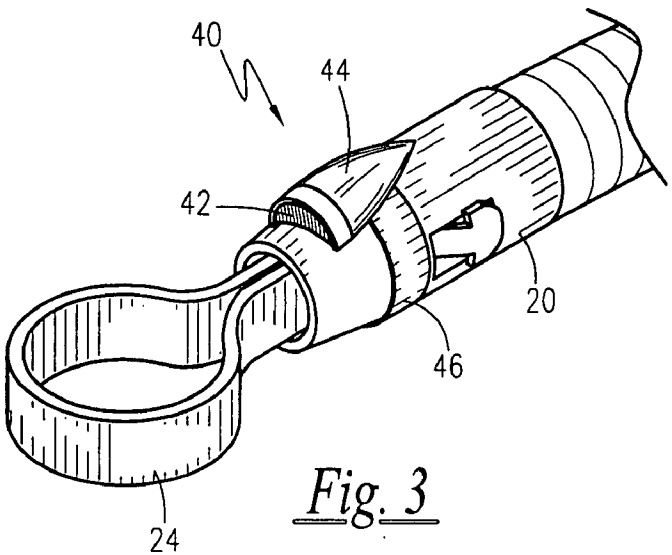
FIG. 3 is a partial perspective view showing an illuminator attachment for use therewith.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. By way of example, and not as a limitation, FIG. 3 shows the addition of an illumination means 40, shown as a battery powered light 42 supported in a housing 44 having a grasping clip 46 capable of frictionally impinging over the collet 20 or distal end 14 of the shaft 12. While other various accessories are envisioned as being capable of use with the multipurpose grasping part holder apparatus 10 of the present invention, these embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A part holder apparatus comprising:

a cylindrical flexible shaft having a distal end opposite a proximal end;

a flexible gripping strap forming a prehensile loop at said distal end, said strap having a first end terminated to an attachment point at an inside of said flexible shaft and with a second end extending through said shaft entirely to extend into an adjustment tab;

wherein said adjustment tab physically communicates with said prehensile loop for adjusting the size and tension of said loop.

2. The part holder apparatus of claim 1, wherein said distal end terminates at a collet with an impingement for preventing said gripping strap from being pulled completely through the shaft.

3. The part holder of claim 2, wherein said impingment comprises a shaft bisecting the distal orifice of the collet.

4. The part holder of claim 1, further comprising a locking means for securing said strap to a fixed, selected position.

5. The part holder of claim 4, wherein said locking means comprises a sliding wedge to impinge said tab against said inside sidewall of said shaft.

6. The part holder of claim 1, further comprising illumination means for illuminating said distal end.

7. The part holder of claim 6, wherein said illumination means comprises a battery powered light supported in a housing, and a grasping clip attached to said housing, said grasping clip capable of frictionally impinging over said distal end of said shaft.

8. The part holder of claim 1, wherein said flexible shaft is electrically insulated or otherwise nonconductive to electrical current.

9. The part holder of claim 1, wherein said flexible gripping strap is electrically insulated or otherwise nonconductive to electrical current.

* * * * *